US010460682B2

(12) United States Patent
Chen

(10) Patent No.: US 10,460,682 B2
(45) Date of Patent: Oct. 29, 2019

(54) METHOD FOR DRIVING DISPLAY PANEL PIXEL WITH LUMINANCE INTERVAL SIGNAL AND DISPLAY DEVICE THEREFOR

(71) Applicants: HKC Corporation Limited, Shenzhen (CN); Chongqing HKC Optoelectronics Technology Co., ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 15/855,363

(22) Filed: Dec. 27, 2017

(65) Prior Publication Data

US 2018/0330680 A1 Nov. 15, 2018

Related U.S. Application Data

(63) Continuation of application No. PCT/CN2017/091641, filed on Jul. 4, 2017.

(30) Foreign Application Priority Data

May 10, 2017 (CN) ..... 2017 1 0327746

(51) Int. Cl.
*G09G 3/36* (2006.01)

(52) U.S. Cl.
CPC ... *G09G 3/3607* (2013.01); *G09G 2300/0443* (2013.01); *G09G 2300/0447* (2013.01); *G09G 2320/028* (2013.01); *G09G 2320/0242* (2013.01); *G09G 2320/0673* (2013.01)

(58) Field of Classification Search
CPC ..... G09G 3/3607; G09G 2300/0447; G09G 2320/0242; G09G 2320/028
See application file for complete search history.

(56) References Cited

U.S. PATENT DOCUMENTS

2017/0162136 A1* 6/2017 Kang ..... G09G 3/3607
2018/0374436 A1* 12/2018 Chen ..... G09G 3/3696

* cited by examiner

*Primary Examiner* — Kwang-Su Yang
(74) *Attorney, Agent, or Firm* — WPAT, PC

(57) ABSTRACT

The present application discloses a method for driving display panel pixel and a display device. The method includes: dividing a pixel unit of a display panel into a plurality of pixel sets; acquiring an original driving data for each pixel sets; acquiring a gray scale value lookup table according to the hue range of the hue; the original driving data of each of the blue sub-pixels in the gray scale value lookup table corresponds to the unequal first voltage signal and the second voltage signal; dividing the blue sub-pixels of each pixel group into a plurality of groups including adjacent a first blue sub-pixel and a second blue sub-pixel; acquiring a first luminance signal and driving the first blue sub-pixel according to the first luminance signal; acquiring a second luminance signal and driving the second blue sub-pixel according to the second luminance signal.

16 Claims, 10 Drawing Sheets

METHOD FOR DRIVING DISPLAY PANEL PIXEL WITH LUMINANCE INTERVAL SIGNAL AND DISPLAY DEVICE THEREFOR

This application claims priority to Chinese Patent Application No. 20171032 7746.7, entitled "METHOD FOR DRIVING DISPLAY PANEL PIXEL AND DISPLAY DEVICE" filed on May 10, 2017, which is incorporated by reference in its entirety.

FIELD OF THE DISCLOSURE

The disclosure relates to a display technical field, and more particularly to a method for driving display panel pixel and display device.

BACKGROUND

Most of the current large-size liquid crystal display panels use negative Vertical Alignment, VA liquid crystal or In-Plane Switching, IPS liquid crystal technology, compared to IPS liquid crystal technology, VA-type liquid crystal display technology has advantages of higher production efficiency and lower manufacturing cost, but has obvious defects in optical properties compared to the IPS liquid crystal technology in optical properties, especially large-size panels in commercial applications need a larger viewing angle presentation, the driving of the liquid crystal of the VA-type is often not meet the needs of the market application in the viewing angle and color shift. By using a front view and side view of the VA-type liquid crystal technology to observe the variation of the gray scale luminance ratio of a red sub-pixel R, a green sub-pixel G, a blue sub-pixel B, it can be found that the luminance of the side view of the blue sub-pixel B is increased with the voltage, the trend of the luminance saturation is significant and fast than the red sub-pixel R and the green sub-pixel G, so that the quality under the observation of the mixing color viewing angle will be a noticeable defect in the bluish color shift.

SUMMARY

According to various embodiments of the present application, a method for driving display panel pixel and display device for solving a viewing angle color shift is provided.

A method for driving display panel pixel, including:

Dividing a pixel unit of a display panel into a plurality of pixel sets;

Acquiring an original driving data for each of the pixel sets, acquiring a hue of each of the pixel sets according to the original driving data;

Acquiring a gray scale value lookup table according to a belonging range of the hue;

The original driving data of every blue sub-pixels in the gray scale value lookup table corresponding to a set of target gray scale value pair, each set of the target gray scale value pair including a first voltage signal and a second voltage signal unequal to each other, a front viewing angle mixing luminance of the blue sub-pixels alternately driven by the first voltage signals and the second voltage signals being equivalent to a front viewing angle luminance of the blue sub-pixels driven by the original driving data;

Dividing the blue sub-pixels of each pixel set into a plurality sets of blue pixel pairs, each blue pixel pair including a first blue sub-pixel and a second blue sub-pixel adjacent to each other, the first blue sub-pixel of one of the blue pixel pairs of the adjacent blue pixel pairs being arranged adjacent to the second blue sub-pixel in the other one of the blue pixel pairs;

Acquiring a first luminance signal according to different weight values from the first voltage signal of the first blue sub-pixel and the first voltage signals of the plurality of adjacent blue sub-pixels, driving the first blue sub-pixel according to the first luminance signal; and Acquiring a second luminance signal according to different weight values from the second voltage signal of the second blue sub-pixel and the second voltage signals of the plurality of adjacent blue sub-pixels, driving the second blue sub-pixel according to the second luminance signal.

A display device, including: a display panel, a pixel unit of the display panel being divided into a plurality of pixel sets; blue sub-pixels of each pixel set being divided into a plurality of blue pixel pairs, each blue pixel pair including a first blue sub-pixel and a second blue sub-pixel adjacent to each other, the first blue sub-pixel of one of the blue pixel pairs of the adjacent blue pixel pairs being arranged adjacent to the second blue sub-pixel in the other one of the blue pixel pairs; a control element, wherein the control element includes: an acquisition unit for acquiring an original driving data for each pixel set; and a calculation unit for acquiring a hue of each pixel set according to the original driving data; acquiring a gray scale value lookup table according to a belonging range of the hue; the original driving data of every blue sub-pixels in the gray scale value lookup table corresponding to a set of target gray scale value pair, each set of the target gray scale value pairs including a first voltage signal and a second voltage signal unequal to each other, the calculation unit making a front viewing angle mixing luminance of the blue sub-pixels alternately driven by the first voltage signals and the second voltage signals being equivalent to a front viewing angle luminance of the blue sub-pixels driven by the original driving data; the calculation unit further for re-acquiring a first luminance signal according to different weight values from the first voltage signal of the first blue sub-pixel and the first voltage signals of the plurality of adjacent blue sub-pixels, re-acquiring a second luminance signal according to different weight values from the second voltage signal of the second blue sub-pixel and the second voltage signals of the plurality of adjacent blue sub-pixels; and a driving element connected to the control element and the display panel, respectively; the driving element for driving the first blue sub-pixels in accordance with the first luminance signal and driving the second blue sub-pixels in accordance with the second luminance signal.

A method for driving display panel pixel, including:

Dividing a pixel unit of a display panel into a plurality of pixel sets;

Acquiring an original driving data for each of the pixel sets, calculating an average gray scale value of various colors of the sub-pixels in each pixel set according to the original driving data, and acquiring the hue of each of the pixel sets according to the average gray scale value of the various colors of the sub-pixels in each pixel set;

Acquiring a gray scale value lookup table according to a belonging range of the hue;

The original driving data of every blue sub-pixels in the gray scale value lookup table corresponding to a set of target gray scale value pair, each set of the target gray scale value pair including a first voltage signal and a second voltage signal unequal to each other, a front viewing angle mixing luminance of the blue sub-pixels alternately driven by the first voltage signals and the second voltage signals being equivalent to a front viewing angle luminance of the blue sub-pixels driven by the original driving data;

Dividing the blue sub-pixels of each pixel set into a plurality sets of blue pixel pairs, each blue pixel pair including a first blue sub-pixel and a second blue sub-pixel adjacent to each other, the first blue sub-pixel of one of the blue pixel pairs of the adjacent blue pixel pairs being arranged adjacent to the second blue sub-pixel in the other one of the blue pixel pairs;

Acquiring a first luminance signal according to different weight values from the first voltage signal of the first blue sub-pixel and the first voltage signals of the plurality of adjacent blue sub-pixels, driving the first blue sub-pixel according to the first luminance signal; and Acquiring a second luminance signal according to different weight values from the second voltage signal of the second blue sub-pixel and the second voltage signals of the plurality of adjacent blue sub-pixels, driving the second blue sub-pixel according to the second luminance signal.

In the method for driving display panel pixel and the display device described above, a plurality of blue sub-pixels in the display area are alternately driven by the unequal first luminance signals and second luminance signals, and a high-low luminance interval signal is used to replace the image sub-pixel signal in the original position, low luminance signal can play a role in improving the viewing angle color shift. The pixels are no longer designed as main pixels and secondary pixels, greatly improving the transmittance of the display panel and reducing the cost of backlight design. For high-resolution display panel development, pixels are no longer having the main pixel and secondary pixel design is more significant for the possibility of improving transmittance and enhance the resolution.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
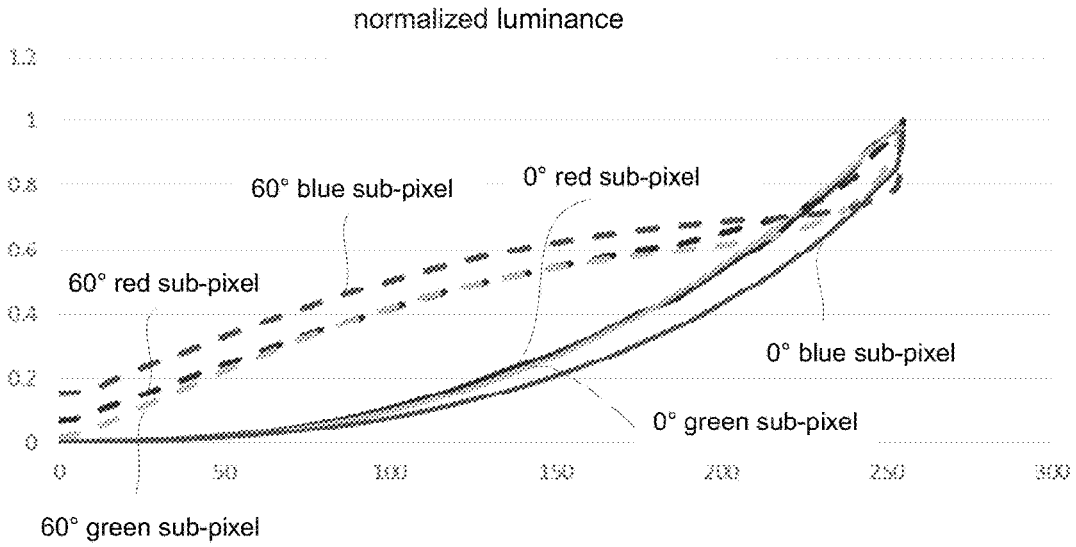
FIG. 1 is a voltage-luminance curve with the 0 degree viewing angle and 60 viewing degree in the embodiment.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "front", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

As shown in FIG. 1, by using a front view and side view of the VA-type liquid crystal technology to observe the variation of the gray scale luminance ratio of a red sub-pixel R, a green sub-pixel G, a blue sub-pixel B, where the ordinate is the luminance and the vertical and horizontal coordinates are the voltage, it can be found that the luminance of the side view of the blue sub-pixel B is increased with the voltage, the trend of the luminance saturation is significant and fast than the red sub-pixel R and the green sub-pixel G, so that the quality under the observation of the mixing color viewing angle will be a noticeable defect in the bluish color shift.

Figure 2:
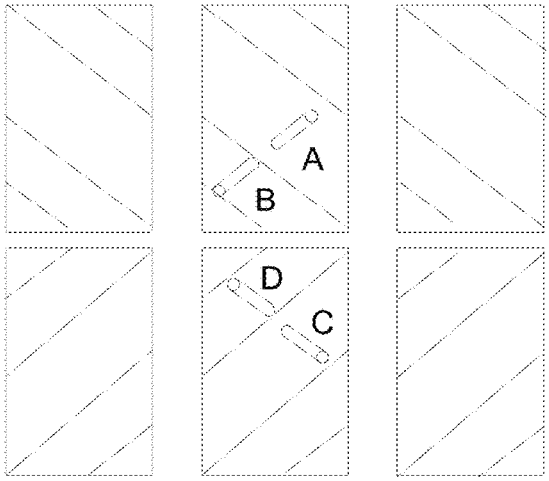
FIG. 2 is a schematic representation of a main pixel and a secondary pixel in an embodiment.
Figure 3:
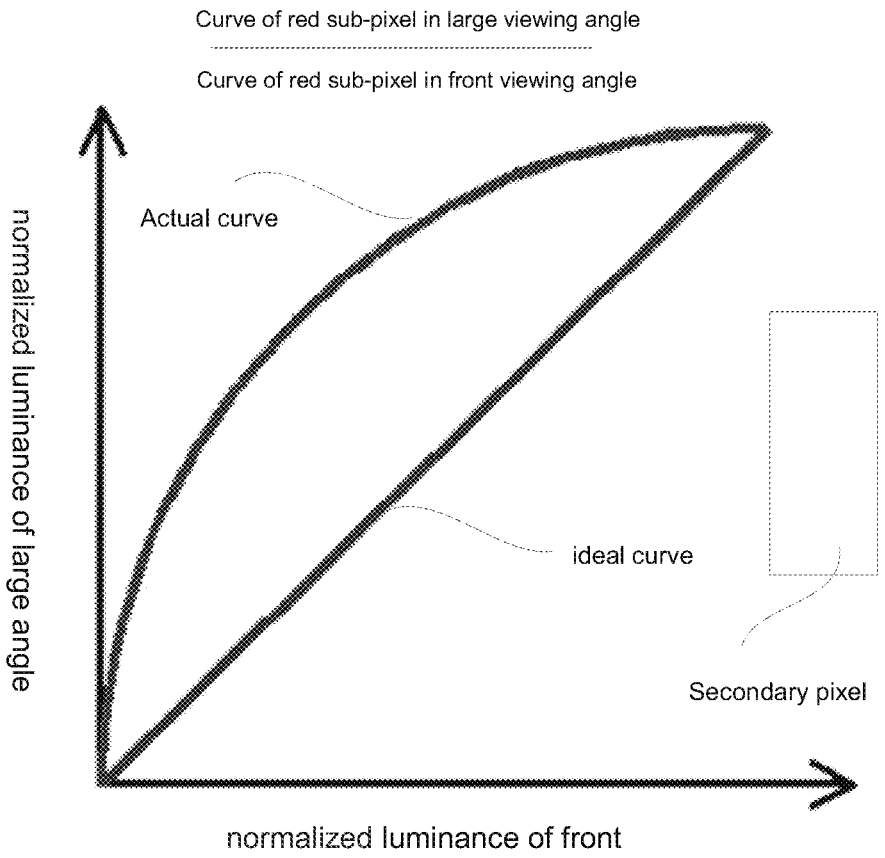
FIG. 3 is a corresponding curve of the pixel with front viewing angle and a large viewing angle in one embodiment.
Figure 4:
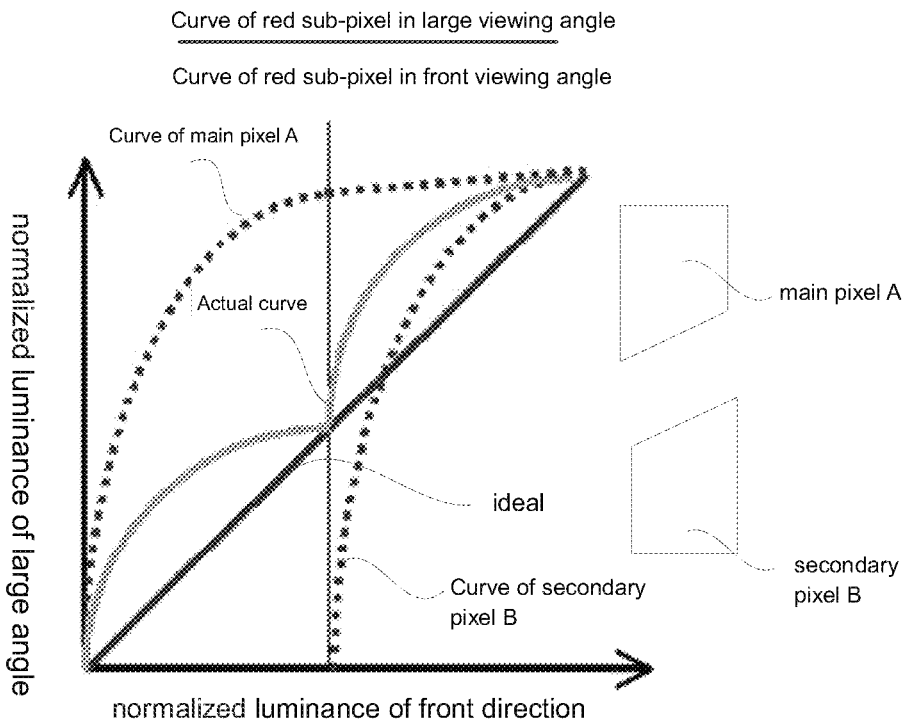
FIG. 4 is a corresponding curve of the main pixel and the secondary pixel with front viewing angle and a large viewing angle in one embodiment.
Figure 5:
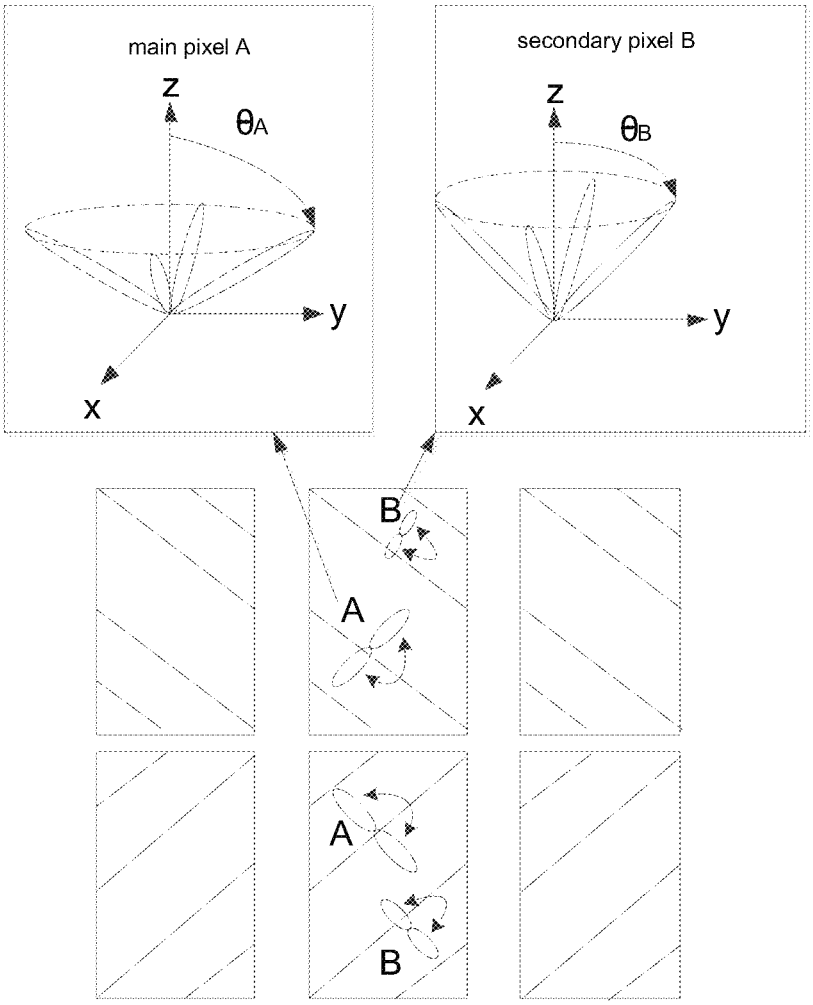
FIG. 5 is a schematic representation of the movement of liquid crystal molecules in one embodiment.

As shown in FIG. 2, in the VA type liquid crystal technique, in order to solve the viewing angle color shift, the RGB sub-pixels are divided into main pixels and secondary pixels, the blue sub-pixel B, the green sub-pixel G and the red sub-pixel R is shown in FIG. 2 from left to right sequentially, taken the green sub-pixel G as an example, the green sub-pixel G is divided into the main pixel A and the secondary pixel B. And then, different driving voltages are supplied to the main pixel and secondary pixel in the space, FIG. 3 is the curve for the sub-pixel not divided into the main pixel and secondary pixel, FIG. 4 is the curve for the sub-pixel divided into the main pixel and secondary pixel, it can be seen that divining the sub-pixel into the main pixel and secondary pixel can effectively solve the shortcomings of viewing angle color shift. FIG. 5 is a schematic representation of the movement of liquid crystal molecules in one embodiment, wherein the motion of the liquid crystal molecules of the green sub-pixel G in the main pixel A and the secondary pixel B under the middle gray scale is shown in FIG. 5. However, such a pixel design requires the design of metal traces or TFT components to drive the secondary pixel, resulting in sacrificing of aperture rate for light transmitting, affecting the transmittance of panel, and a direct result of increasing the backlight cost.

Figure 6:
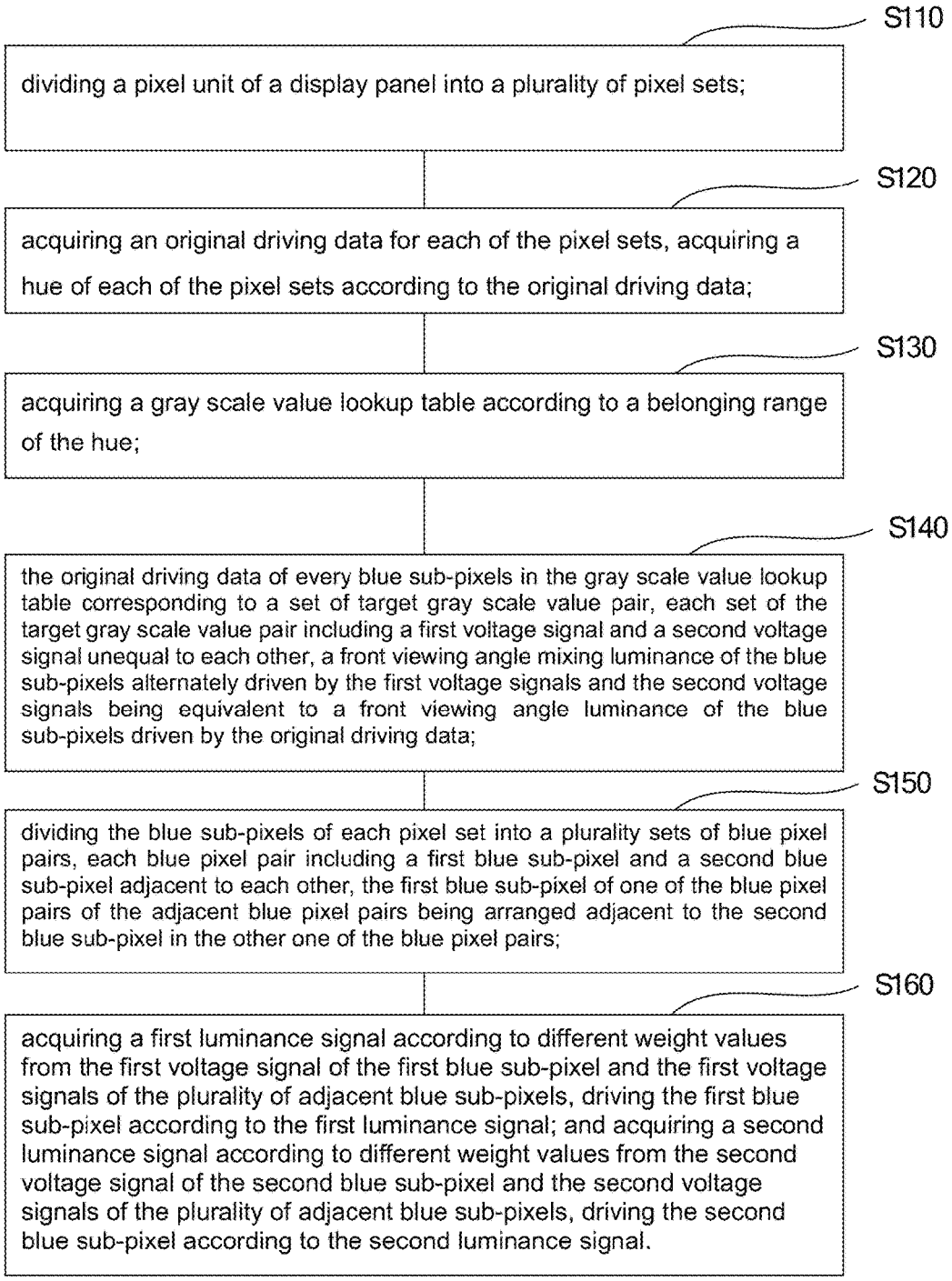
FIG. 6 is a flow chart of a method for driving pixel of display panel in another embodiment.

FIG. 6 is a flow chart of a method for driving pixel of display panel in another embodiment. The method for driving pixel of display panel can improve the color shift (or chromatic aberration) defects caused by the mismatch of the refractive index of the large viewing angle of the liquid crystal. In particular, can effectively improve the color shift defects caused by premature saturation of the large viewing angle of the blue sub-pixel. The display panel can be TN (Twisted Nematic), OCB (Optically Composed Birefringence), VA (Vertical Alignment) type liquid crystal display panel and curved liquid crystal display panel, but is not limited thereto. Referring to FIG. 6, the method for driving pixel of display panel is used to drive the blue sub-pixel of a display panel, the method including the steps of:

S110: dividing a pixel unit of a display panel into a plurality of pixel sets.

Figure 10:
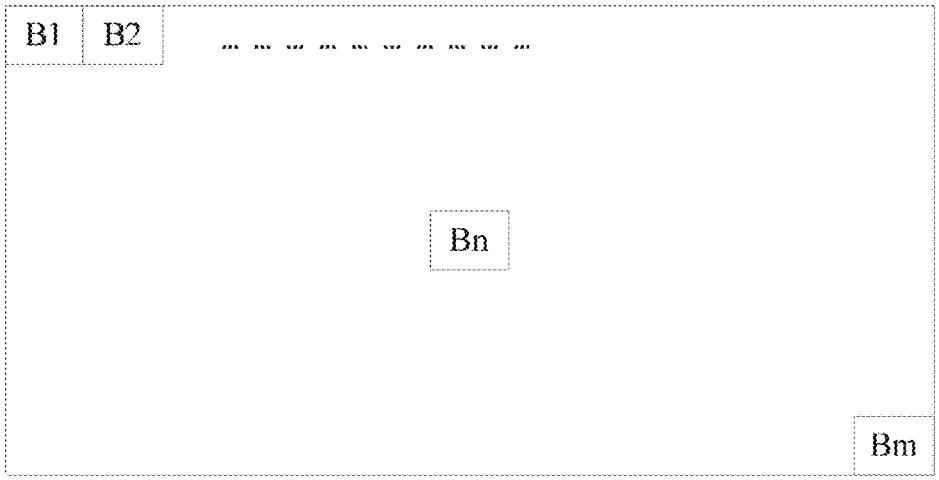
FIG. 10 is a schematic diagram of a display panel in another embodiment.
Figure 11:
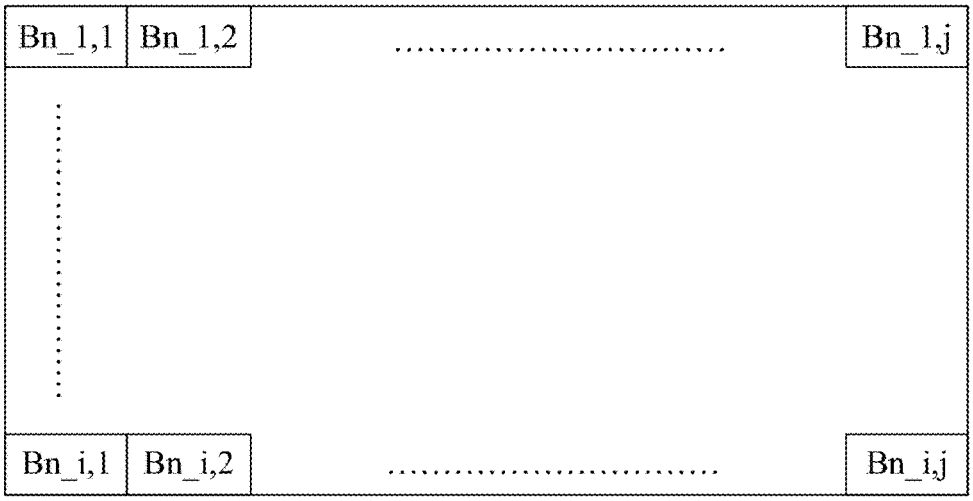
FIG. 11 is a schematic diagram of a pixel set in another embodiment.

In the present embodiment, the display panel at least includes blue sub-pixels. As shown in FIG. 10, the full-size blue display area in the spatial display panel is divided into a plurality of pixel sets n=0, 1, 2 . . . n . . . , m, respectively marked as B1, B2, B3 . . . Bn . . . Bm. As shown in FIG. 11, each pixel set n contains a plurality of blue sub-pixels, the blue sub-pixel in one of the pixel set n is arranged as Bn_1,1, Bn_1,2, . . . Bn_i, j. The display panel is divided into a plurality of pixel sets, the more the dividing of the pixel sets, the more the dividing sets of the blue signal during driving, the display performance of the blue is better. The pixel set includes a plurality of blue sub-pixels, the less the blue sub-pixels, the higher the resolution of the blue color, but the computational is also increased, a value with reasonable computational and higher resolution is required, such as 10* 10 times. In other embodiments, the number of pixels included in each pixel set can be set as desired.

S120: acquiring an original driving data for each of the pixel sets, acquiring a hue of each of the pixel sets according to the original driving data.

Figure 12:
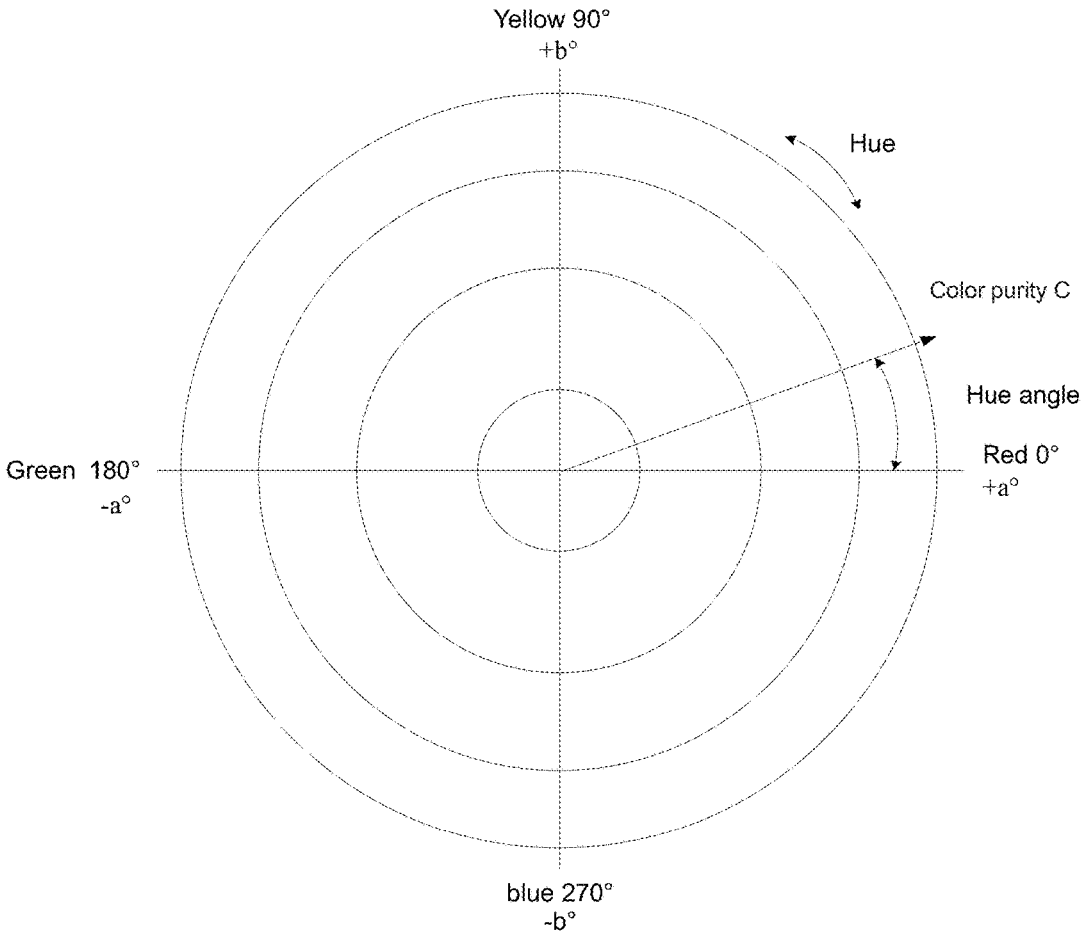
FIG. 12 is a schematic diagram of a CIE LCH color space system in another embodiment.
Figure 13:
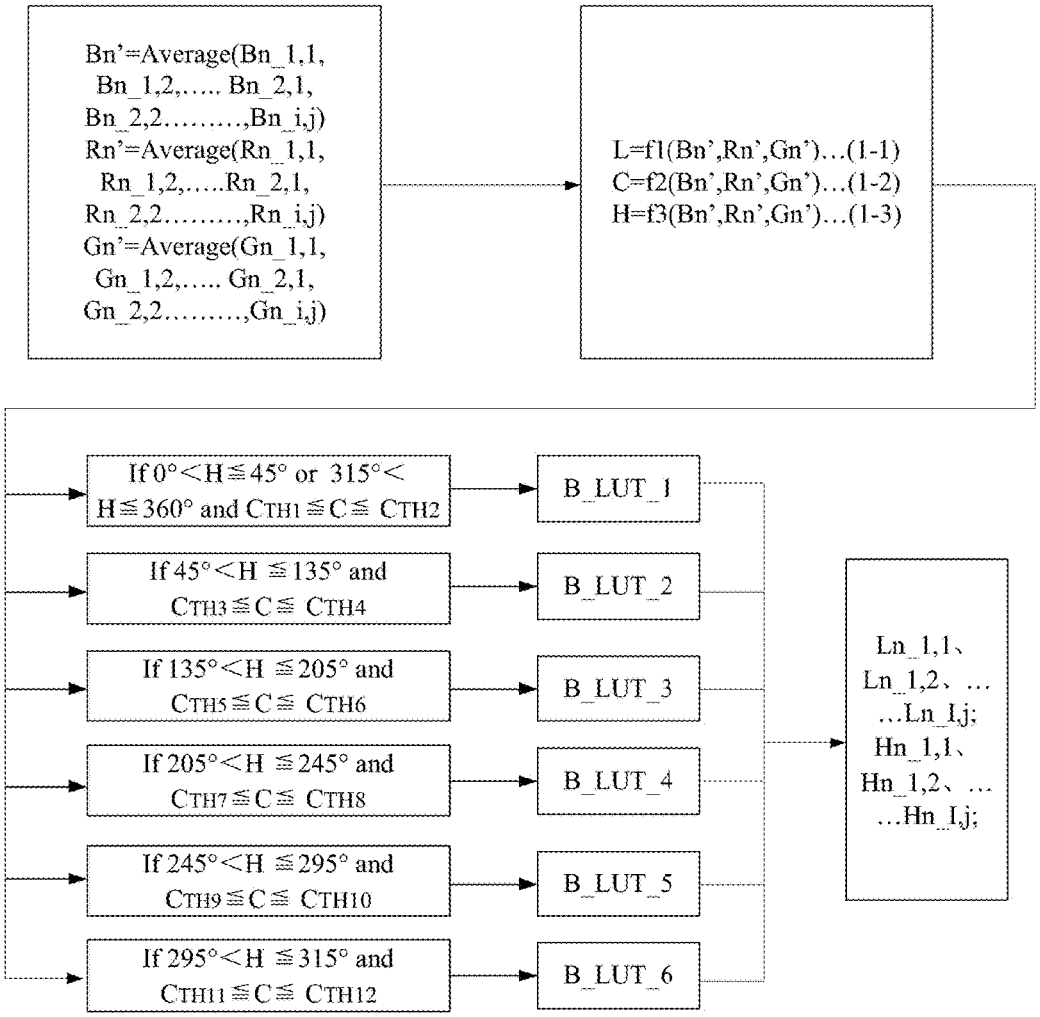
FIG. 13 is a flow chart of acquiring a combination of a first luminance signal and a second luminance signal for a plurality of blue sub-pixels of a pixel set in another embodiment.

The hue is obtained according to the CIE LCH color space system and a reference to the function of each of the color space coordinates of the CIE specification. Specifically, L=f1(R、G、B), C=f2(R、G、B), H=f3(R、G、B), wherein L is for the luminance, C is for the color purity, represents the vividness of the color, H is for the hue, that is, the color represents. The above function relationship is known according to the CIE specification. The CIE LCH color space system is shown in FIG. 12. In the CIE LCH color space system, 0~360° represents the color with different hue. Wherein, 0° is defined as red, 90° is yellow, 180° is green, and 270° is blue. The hue H of each pixel s et can be calculated and obtained by the average driving voltage of the pixel set.

Specifically, each pixel set includes red sub-pixels, green sub-pixels, and blue sub-pixels. Therefore, the present average gray scale values R'n, G'n, and B'n of the respective color sub-pixels of each pixel set are obtained first.

$$Bn'=\text{Average}(Bn_1,1,Bn_1,2, \ldots Bn_2,1, Bn_2,2, \ldots Bn_i,j);$$

$$Rn'=\text{Average}(Rn_1,1,Rn_1,2, \ldots Rn_2,1, Rn_2,2, \ldots Rn_i,j);$$

$$Gn'=\text{Average}(Gn_1,1,Gn_1,2, \ldots Gn_2,1, Gn_2,2, \ldots Gn_i,j).$$

Wherein, n represents the sequence number of the divided pixel set, (i, j) represents the sequence number of the red sub-pixel, the green sub-pixel, and the blue sub-pixel in the entire pixel set. Therefore, the above average gray scale values R'n, G'n and B'n are brought into the function relation H=f3 (R, G, B) to obtain the hue of the corresponding pixel set:

$$H=f3(R'n,G'n,B'n).$$

In one embodiment, the color purity C of each pixel set is also obtained according to the above average gray scale value. The color purity C ranges from 0 to 100, and 100 represents the most vivid colors. The value of the color purity C to a certain extent shows the voltage signal of the display driving of the liquid crystal display device. By bringing the above average gray scale values R'n, G'n and B'n into the function relation C=f2(R, G, B), the color purity of the corresponding pixel set can be obtained:

$$C=f2(R'n,G'n,B'n).$$

S130: acquiring a gray scale value lookup table according to a belonging range of the hue.

Before determining the hue range to which the hue of each pixel set belongs, the hue value is divided into a plurality of ranges in advance. Each range can be determined according to the degree of color shift required to be improved. In the present embodiment, the hue value is divided into six regions: the first region, 0°<H≤45° and 315°<H≤360°; the second region, 45°<H≤135°; the third region, 135°<H≤205°; the fourth zone, 205°<H≤245°; the fifth zone, 245°<H≤295°; and sixth zone, 295°<H≤315°. Therefore, the range to which the respective hue groups can be determined according to the obtained hue of each pixel set. It will be understood that, the division of the hue values can be divided according to actual needs, and is not limited thereto.

S140: the original driving data of every blue sub-pixels in the gray scale value lookup table corresponding to a set of target gray scale value pair, each set of the target gray scale value pair including a first voltage signal and a second voltage signal unequal to each other, a front viewing angle mixing luminance of the blue sub-pixels alternately driven by the first voltage signals and the second voltage signals being equivalent to a front viewing angle luminance of the blue sub-pixels driven by the original driving data.

The gray scale value of each blue sub-pixel in the gray scale value lookup table corresponds to a set of target gray scale pair. Each pair of target gray scale value sets includes an unequal first voltage signals and a second voltage signal, the first voltage signal and the second voltage signal being required to be satisfied, such that the front viewing angle mixing luminance of the blue sub-pixel alternately driven by the first voltage signal and the second voltage signal is equivalent to the front viewing angle luminance of the original driving data to drive the blue sub-pixel. Preferably, the large viewing angle luminance corresponding to the first voltage signal and the second voltage signal is as close as possible to the front viewing angle luminance of the original driving data. In one embodiment, the difference between the first voltage signal and the second voltage signal needs to be greater than preset difference range, thereby ensuring that the values of the two gray scales in the target gray scale value sets has a larger gray scale difference. In the present embodiment, the large viewing angle can be defined as greater than 60°, or can be defined according to the user. The acquisition of the target gray scale value sets can be found by finding the gray scale value lookup table (LUT).

Different hue values have different influence on the viewing angle color shift, so different hue ranges need to correspond to different gray scale value lookup tables, so that the target gray scale value sets are more suitable for the hue range can be obtained corresponding to different hue ranges, the gray scale value corresponds to the driving voltage, that is, to perform the driving by a more suitable driving voltage, and then it is possible to ensure that the variation curve of the luminance under the side view of the blue sub-pixel after adjustment under the variation of the gray scale is closer to the variation curve under the front viewing. The corresponding relation table of each hue range and gray scale value lookup table can be stored in advance in the storage unit, so that the corresponding driving voltage can be determined according to the gray scale signal acquired from the lookup table.

For example, the gray scale value lookup table LUT1 is used when the hue range of the hue is the first region, and the gray scale value lookup table LUT2 is used when the hue range of the hue is the second region, as shown in the following table:

| | LUT1 | | LUT2 | |
|---|---|---|---|---|
| Inputting gray scale value | Hn_i,j | Ln_i,j | Hn_i,j | Ln_i,j |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

The above is merely a specific embodiment, and the division of the hue range and the correspondence relationship between the respective hue range and the gray scale value lookup table are not limited to the implementations defined in the above embodiments.

In another embodiment, the gray scale value lookup table needs to be retrieved simultaneously according to the range of the hue and color purity are displayed. Specifically, different hue ranges have different color purity settings. The range setting of the color purity corresponding to the different regions can also be determined according to the degree of color change actually need to be improved. For example, the first region of the hue range corresponds to the first color purity range $C_{TL1} \leq C \leq C_{TH1}$, the second region of the hue range corresponds to the second color purity range $C_{TL2} \leq C \leq C_{TH2}$; the third region of the hue range corresponds to the third color purity range $C_{TL3} \leq C \leq C_{TH3}$; and so on. Therefore, according to the obtained hue and color purity can determine the range to which it belongs. In the present embodiment, for example, when both the hue H and the color purity C are satisfied the following two conditions, it can be determined that it belongs to the first range:

$$0° < H \leq 45° \text{ or } 315° < H \leq 360°;$$

$$C_{TL1} \leq C \leq C_{TH1}.$$

When both the hue H and color purity C are satisfied the following two conditions, it can be determined that it belongs to the second range:

$$45° < H \leq 135°;$$

$$C_{TL2} \leq C \leq C_{TH2}.$$

Therefore, according to the range of the hue and color purity belongs to the corresponding gray scale value lookup table can be obtained.

According to the average signal Bn' and Rn', Gn' to check the lookup table (LUT), to obtain the set of the first voltage signal and the second voltage signal corresponding to the blue sub-pixel are Ln_i, j and Hn_i, j, that is, the combination of the low voltage signal and the high voltage signal. In this way, the image signals with different luminance have different average values to obtain the different combination of the first voltage signal and the second voltage signal by checking with the table, so that the gamma curve of the blue sub-pixel is closer to the target gamma curve.

S150: dividing the blue sub-pixels of each pixel set into a plurality sets of blue pixel pairs, each blue pixel pair including a first blue sub-pixel and a second blue sub-pixel adjacent to each other, the first blue sub-pixel of one of the blue pixel pairs of the adjacent blue pixel pairs being arranged adjacent to the second blue sub-pixel in the other one of the blue pixel pairs.

The blue sub-pixels of each pixel set are divided into a plurality of sets of blue pixel pairs, each pair of blue pixel pairs including adjacent first blue sub-pixel and second blue sub-pixels, wherein the first blue sub-pixel and the second blue sub-pixels can be laterally adjacent or longitudinally adjacent. The first blue sub-pixel of the adjacent blue pixel pair is shifted arranged, that is the first blue sub-pixel in a set of blue pixel pairs is adjacent to the second blue sub-pixel in the other set of blue pixel pairs.

S160: acquiring a first luminance signal according to different weight values from the first voltage signal of the first blue sub-pixel and the first voltage signals of the plurality of adjacent blue sub-pixels, driving the first blue sub-pixel according to the first luminance signal; and acquiring a second luminance signal according to different weight values from the second voltage signal of the second blue sub-pixel and the second voltage signals of the plurality of adjacent blue sub-pixels, driving the second blue sub-pixel according to the second luminance signal.

For example, the first voltage signal is a low voltage signal, the second voltage signal is a high voltage signal, the first blue sub-pixel acquires its own low voltage signal and the adjacent low voltage signal, and then obtains a new low voltage signal according to different weight, that is, the first luminance signal, by the same way, the second blue sub-pixel acquires a new high-voltage signal, that is the second luminance signal, and then drives the first blue sub-pixel and the second low-voltage signal by the new low-voltage signal and the new high-voltage signal, a high and a low luminance interval signal to replace the sub-pixel signal of the image in the original location, the low luminance signal can play a role in improving the viewing angle color shift. The high luminance signal maintains the display resolution. In another embodiment, the first voltage signal is a high voltage signal, and the second voltage signal is a low voltage signal.

In the present embodiment, the full-size blue display area in the spatial display panel is divided into a plurality of pixel sets, a high and a low luminance interval signal to replace the sub-pixel signal of the image in the original location, the low luminance signal can play a role in improving the viewing angle color shift. In the design of maintaining a high transmittance, using a pixel design that does not compensate for the low color shift, the human eye feels less sensitive to the resolution of the blue, giving the blue sub-pixel a high and low luminance interval signal is controlled so that the variation of the blue luminance of the side view is controlled. The color shift defects caused by the mismatch of the refractive index of the large viewing angle of the liquid crystal is improved, especially for TN, OCB, VA type LCD panel. The pixels are no longer designed as the main pixels and secondary pixels, greatly enhance the transmittance of the display panel, reduce the cost of backlight design, not increase the difficulty of the display panel process, not affect product yield, and is more significant in increasing the transmittance and resolution for high-resolution display panel.

Figure 7:
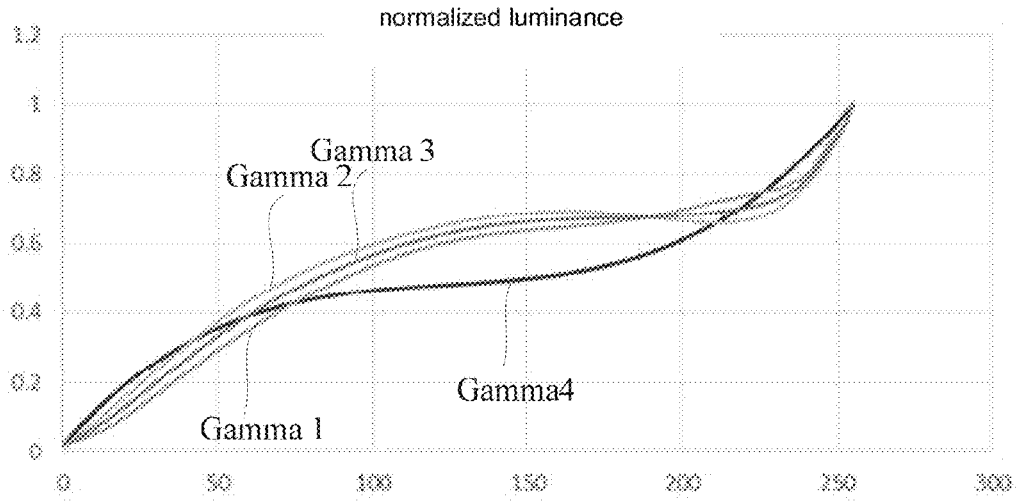
FIG. 7 is a voltage-luminance curve of the blue sub-pixel in another embodiment.
Figure 8:
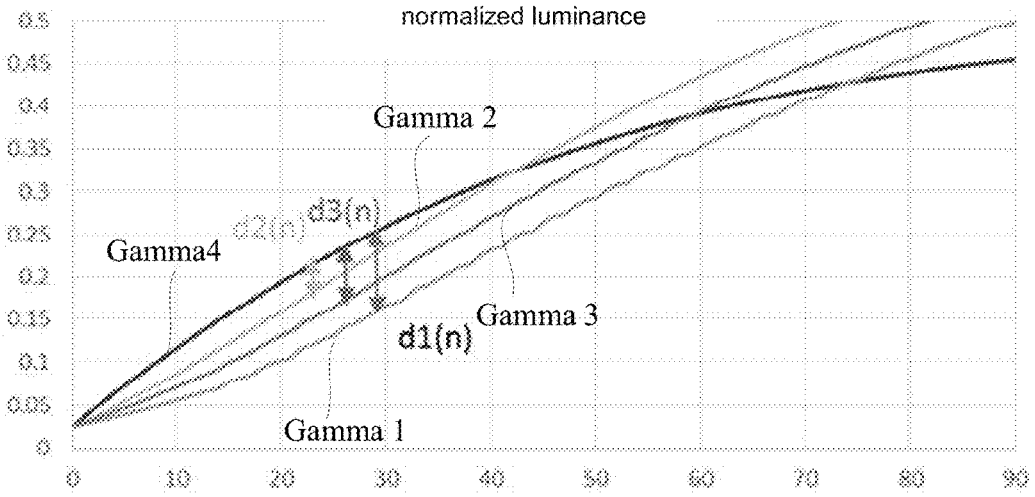
FIG. 8 is a voltage-luminance curve of the blue sub-pixel with respect to the low voltage portion in another embodiment.
Figure 9:
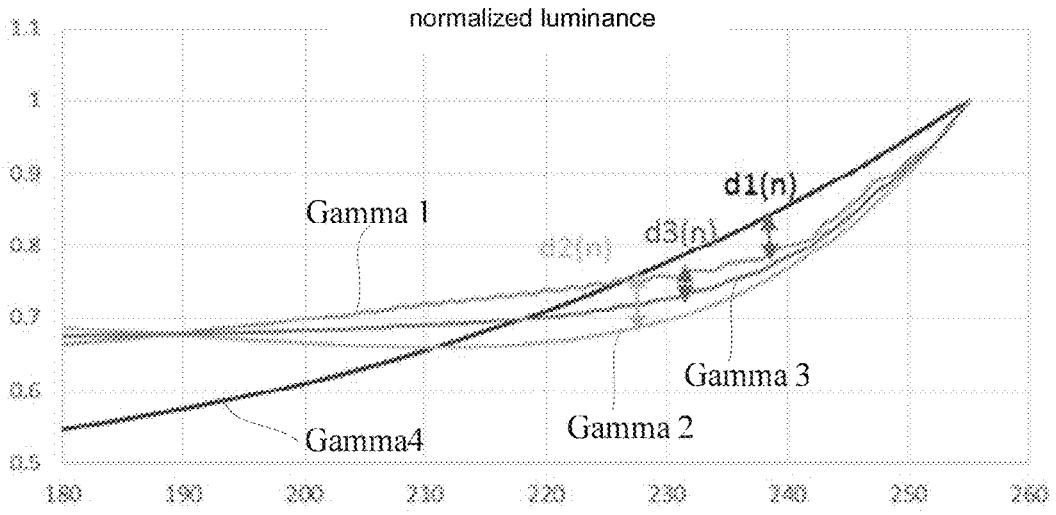
FIG. 9 is a voltage-luminance curve of the blue sub-pixel with respect to the high voltage portion in another embodiment.

The effect of improving the color shift of the driving method in the present embodiment will be further described with reference to FIGS. 7 to 9. The trend of increasing the luminance of the blue sub-pixel B with the increasing of the voltage is close to the red sub-pixel R, or by controlling the luminance saturation trend of the red sub-pixel R, the green sub-pixel G, and the blue sub-pixel B in front view to decrease the serious defects of viewing angle color shift. As shown in FIG. 7, the gamma4 curve is the target curve of the variation curve of the voltage with the luminance of the blue sub-pixel, the not changing the ratio of the RGB luminance in front view must be met by the high and low luminance interval signal of display in the blue sub-pixel space, the high voltage signals and the low voltage signals of the high and low luminance interval signal of display in the blue sub-pixel space has a plurality of combinations, each of the combinations makes the different condition of the luminance saturation variation with the voltage in side view. The gamma curve by the combination of the first pair of high voltage signals and the low voltage signal in the blue sub-pixel of FIG. 7 is a gamma curve1, the gamma curve of the second pair is a gamma2 curve, and it can be seen that the condition of the luminance saturation variation with the voltage in side view is different in the two pairs from the gamma1 and gamma2 curves. As shown in FIG. 8, when the relationship between the low voltage and the luminance variation is considered, the difference between the actual luminance and the target luminance of the gamma1 curve of the first pair is d1 (n), the difference is much larger than the difference between the actual luminance and the target luminance of the gamma2 curve of the second pair d2 (n). However, as shown in FIG. 9, when the relationship between the high voltage and the luminance variation is considered, the difference between the actual luminance and the target luminance of the gamma1 curve of the first pair is d1 (n), the difference is much smaller than the difference between the actual luminance and the target luminance of the gamma2 curve of the second pair d2 (n). when the combination of the high voltage and low voltage of the high and low luminance interval signal of the display in the blue sub-pixel space is gamma1 curve, it is suitable when the image content represent a higher blue luminance signal, in the contrary, when the combination of the high voltage and low voltage of the high and low luminance interval signal of the display in the blue sub-pixel space is gamma2 curve, it is suitable when the image content represent a lower blue luminance signal.

It can be found that it will have a different degree of difference with the target gamma curve for the local high voltage, low voltage and voltage curve in different combinations of design, a combination of a high voltage and low voltage for display the high and low luminance interval signal in the blue sub-pixel space display cannot simultaneously meet the demand of close the high and low voltage luminance and target luminance.

As shown in FIG. 10, the blue sub-pixel in one pixel set n is a blue sub-pixel range of 10*10, the blue sub-pixels are Bn_1,1, Bn_1,2, . . . Bn_10,10. In order to make the gamma curve of the blue sub-pixel in side view closer to the gamma curve in front view, the different blue sub-pixel signals can theoretically given a loop switch by the high and low voltage timing in cyclically timing switching to obtain the combinations of the high and low voltage closed to the observation effect of front view and the side view, the signal of Table 1 is obtained by cyclically timing switching the low voltage signal of Table 2 and the high voltage signal of Table 3 at a certain timing. The first voltage signal is smaller than the original signal, the second voltage signal is equal to or greater than the original signal, and the luminance equal to or close to the original signal can be obtained by cyclically timing switching.

TABLE 1

| | | | | | | | | | |
|---|---|---|---|---|---|---|---|---|---|
| Bn__1, 1 | Bn__1, 2 | Bn__1, 3 | Bn__1, 4 | Bn__1, 5 | Bn__1, 6 | Bn__1, 7 | Bn__1, 8 | Bn__1, 9 | Bn__1, 10 |
| Bn__2, 1 | Bn__2, 2 | Bn__2, 3 | Bn__2, 4 | Bn__2, 5 | Bn__2, 6 | Bn__2, 7 | Bn__2, 8 | Bn__2, 9 | Bn__2, 10 |
| Bn__3, 1 | Bn__3, 2 | Bn__3, 3 | Bn__3, 4 | Bn__3, 5 | Bn__3, 6 | Bn__3, 7 | Bn__3, 8 | Bn__3, 9 | Bn__3, 10 |
| Bn__4, 1 | Bn__4, 2 | Bn__4, 3 | Bn__4, 4 | Bn__4, 5 | Bn__4, 6 | Bn__4, 7 | Bn__4, 8 | Bn__4, 9 | Bn__4, 10 |
| Bn__5, 1 | Bn__5, 2 | Bn__5, 3 | Bn__5, 4 | Bn__5, 5 | Bn__5, 6 | Bn__5, 7 | Bn__5, 8 | Bn__5, 9 | Bn__5, 10 |
| Bn__6, 1 | Bn__6, 2 | Bn__6, 3 | Bn__6, 4 | Bn__6, 5 | Bn__6, 6 | Bn__6, 7 | Bn__6, 8 | Bn__6, 9 | Bn__6, 10 |
| Bn__7, 1 | Bn__7, 2 | Bn__7, 3 | Bn__7, 4 | Bn__7, 5 | Bn__7, 6 | Bn__7, 7 | Bn__7, 8 | Bn__7, 9 | Bn__7, 10 |
| Bn__8, 1 | Bn__8, 2 | Bn__8, 3 | Bn__8, 4 | Bn__8, 5 | Bn__8, 6 | Bn__8, 7 | Bn__8, 8 | Bn__8, 9 | Bn__8, 10 |
| Bn__9, 1 | Bn__9, 2 | Bn__9, 3 | Bn__9, 4 | Bn__9, 5 | Bn__9, 6 | Bn__9, 7 | Bn__9, 8 | Bn__9, 9 | Bn__9, 10 |
| Bn__10, 1 | Bn__10, 2 | Bn__10, 3 | Bn__10, 4 | Bn__10, 5 | Bn__10, 6 | Bn__10, 7 | Bn__10, 8 | Bn__10, 9 | Bn__10, 10 |

TABLE 2

| | | | | | | | | | |
|---|---|---|---|---|---|---|---|---|---|
| Ln_1, 1 | Ln_1, 2 | Ln_1, 3 | Ln_1, 4 | Ln_1, 5 | Ln_1, 6 | Ln_1, 7 | Ln_1, 8 | Ln_1, 9 | Ln_1, 10 |
| Ln_2, 1 | Ln_2, 2 | Ln_2, 3 | Ln_2, 4 | Ln_2, 5 | Ln_2, 6 | Ln_2, 7 | Ln_2, 8 | Ln_2, 9 | Ln_2, 10 |
| Ln_3, 1 | Ln_3, 2 | Ln_3, 3 | Ln_3, 4 | Ln_3, 5 | Ln_3, 6 | Ln_3, 7 | Ln_3, 8 | Ln_3, 9 | Ln_3, 10 |
| Ln_4, 1 | Ln_4, 2 | Ln_4, 3 | Ln_4, 4 | Ln_4, 5 | Ln_4, 6 | Ln_4, 7 | Ln_4, 8 | Ln_4, 9 | Ln_4, 10 |
| Ln_5, 1 | Ln_5, 2 | Ln_5, 3 | Ln_5, 4 | Ln_5, 5 | Ln_5, 6 | Ln_5, 7 | Ln_5, 8 | Ln_5, 9 | Ln_5, 10 |
| Ln_6, 1 | Ln_6, 2 | Ln_6, 3 | Ln_6, 4 | Ln_6, 5 | Ln_6, 6 | Ln_6, 7 | Ln_6, 8 | Ln_6, 9 | Ln_6, 10 |
| Ln_7, 1 | Ln_7, 2 | Ln_7, 3 | Ln_7, 4 | Ln_7, 5 | Ln_7, 6 | Ln_7, 7 | Ln_7, 8 | Ln_7, 9 | Ln_7, 10 |
| Ln_8, 1 | Ln_8, 2 | Ln_8, 3 | Ln_8, 4 | Ln_8, 5 | Ln_8, 6 | Ln_8, 7 | Ln_8, 8 | Ln_8, 9 | Ln_8, 10 |
| Ln_9, 1 | Ln_9, 2 | Ln_9, 3 | Ln_9, 4 | Ln_9, 5 | Ln_9, 6 | Ln_9, 7 | Ln_9, 8 | Ln_9, 9 | Ln_9, 10 |
| Ln_10, 1 | Ln_10, 2 | Ln_10, 3 | Ln_10, 4 | Ln_10, 5 | Ln_10, 6 | Ln_10, 7 | Ln_10, 8 | Ln_10, 9 | Ln_10, 10 |

TABLE 3

| | | | | | | | | | |
|---|---|---|---|---|---|---|---|---|---|
| Hn_1, 1 | Hn_1, 2 | Hn_1, 3 | Hn_1, 4 | Hn_1, 5 | Hn_1, 6 | Hn_1, 7 | Hn_1, 8 | Hn_1, 9 | Hn_1, 10 |
| Hn_2, 1 | Hn_2, 2 | Hn_2, 3 | Hn_2, 4 | Hn_2, 5 | Hn_2, 6 | Hn_2, 7 | Hn_2, 8 | Hn_2, 9 | Hn_2, 10 |
| Hn_3, 1 | Hn_3, 2 | Hn_3, 3 | Hn_3, 4 | Hn_3, 5 | Hn_3, 6 | Hn_3, 7 | Hn_3, 8 | Hn_3, 9 | Hn_3, 10 |
| Hn_4, 1 | Hn_4, 2 | Hn_4, 3 | Hn_4, 4 | Hn_4, 5 | Hn_4, 6 | Hn_4, 7 | Hn_4, 8 | Hn_4, 9 | Hn_4, 10 |
| Hn_5, 1 | Hn_5, 2 | Hn_5, 3 | Hn_5, 4 | Hn_5, 5 | Hn_5, 6 | Hn_5, 7 | Hn_5, 8 | Hn_5, 9 | Hn_5, 10 |
| Hn_6, 1 | Hn_6, 2 | Hn_6, 3 | Hn_6, 4 | Hn_6, 5 | Hn_6, 6 | Hn_6, 7 | Hn_6, 8 | Hn_6, 9 | Hn_6, 10 |
| Hn_7, 1 | Hn_7, 2 | Hn_7, 3 | Hn_7, 4 | Hn_7, 5 | Hn_7, 6 | Hn_7, 7 | Hn_7, 8 | Hn_7, 9 | Hn_7, 10 |
| Hn_8, 1 | Hn_8, 2 | Hn_8, 3 | Hn_8, 4 | Hn_8, 5 | Hn_8, 6 | Hn_8, 7 | Hn_8, 8 | Hn_8, 9 | Hn_8, 10 |
| Hn_9, 1 | Hn_9, 2 | Hn_9, 3 | Hn_9, 4 | Hn_9, 5 | Hn_9, 6 | Hn_9, 7 | Hn_9, 8 | Hn_9, 9 | Hn_9, 10 |
| Hn_10, 1 | Hn_10, 2 | Hn_10, 3 | Hn_10, 4 | Hn_10, 5 | Hn_10, 6 | Hn_10, 7 | Hn_10, 8 | Hn_10, 9 | Hn_10, 10 |

The original blue sub-pixel signals Bn_i, j shown in Table 1 are combined with the high and low voltage signals as shown in Table 2 and Table 3 to improve the viewing angle color shift by presented sequentially. But by the limitation of design for charging limit capability of the display device, the visual observation will see a serious luminance flicker under low frame scanning frequency. Therefore, the characteristics of the small impact for the observation of the human eye resolution to blue is used, the high and low luminance signal combinations Ln_i, j and Hn_i, j are staggered arrangement as shown in Table 4 spatially at the way of scarifying the resolution. In the maintenance of the original image frame frequency display under the premise of the panel hardware design does not require the corresponding difficult design of high frame rate, and do not sacrifice too many the original image resolution, the plurality of the blue sub-pixel in the display area is using the high and low luminance interval signal to replace the image sub-pixel signal at that original position to improve the color shift.

Taking the individual blue sub-pixels into account, the plurality of the blue sub-pixels in space is as the unit. The high and low luminance interval signal is used to replace the image sub-pixel signal at that original position of the blue sub-pixels in the unit. As shown in Table 4, every five blue sub-pixels in the space are as one unit. In this unit, Bn_3, 4 is presented with a first luminance signal, the low luminance signal can play a role in improving the viewing angle color shift. In order to maintain the presentation of the pixel resolution, the first voltage signal of the other blue sub-pixels of the unit i.e., the low voltage of the sub-pixels adjacent to Bn_3,4 (Bn_2,4, Bn_3,3, Bn_3,5, Bn_4,4) is assigned to the first voltage signal of Bn_3,4 in the unit.

The calculation of the low luminance signal in specific position of the unit is the statistical that all sub-pixels in the unit need to be given low luminance signal compensation theoretically, and the actual positional influence of the corresponding position of the individual sub-pixels in the unit is weighted, so that the compensation effect of the low-luminance sub-pixel signal can be met the effect of averaging required compensation of the unit.

TABLE 4

| | | | | | | | | | |
|---|---|---|---|---|---|---|---|---|---|
| Hn_1, 1 | Ln_1, 2 | Hn_1, 3 | Ln_1, 4 | Hn_1, 5 | Ln_1, 6 | Hn_1, 7 | Ln_1, 8 | Hn_1, 9 | Ln_1, 10 |
| Ln_2, 1 | Hn_2, 2 | Ln_2, 3 | Hn_2, 4 | Ln_2, 5 | Hn_2, 6 | Ln_2, 7 | Hn_2, 8 | Ln_2, 9 | Hn_2, 10 |
| Hn_3, 1 | Ln_3, 2 | Hn_3, 3 | Ln_3, 4 | Hn_3, 5 | Ln_3, 6 | Hn_3, 7 | Ln_3, 8 | Hn_3, 9 | Ln_3, 10 |
| Ln_4, 1 | Hn_4, 2 | Ln_4, 3 | Hn_4, 4 | Ln_4, 5 | Hn_4, 6 | Ln_4, 7 | Hn_4, 8 | Ln_4, 9 | Hn_4, 10 |
| Hn_5, 1 | Ln_5, 2 | Hn_5, 3 | Ln_5, 4 | Hn_5, 5 | Ln_5, 6 | Hn_5, 7 | Ln_5, 8 | Hn_5, 9 | Ln_5, 10 |
| Ln_6, 1 | Hn_6, 2 | Ln_6, 3 | Hn_6, 4 | Ln_6, 5 | Hn_6, 6 | Ln_6, 7 | Hn_6, 8 | Ln_6, 9 | Hn_6, 10 |
| Hn_7, 1 | Ln_7, 2 | Hn_7, 3 | Ln_7, 4 | Hn_7, 5 | Ln_7, 6 | Hn_7, 7 | Ln_7, 8 | Hn_7, 9 | Ln_7, 10 |
| Ln_8, 1 | Hn_8, 2 | Ln_8, 3 | Hn_8, 4 | Ln_8, 5 | Hn_8, 6 | Ln_8, 7 | Hn_8, 8 | Ln_8, 9 | Hn_8, 10 |
| Hn_9, 1 | Ln_9, 2 | Hn_9, 3 | Ln_9, 4 | Hn_9, 5 | Ln_9, 6 | Hn_9, 7 | Ln_9, 8 | Hn_9, 9 | Ln_9, 10 |
| Ln_10, 1 | Hn_10, 2 | Ln_10, 3 | Hn_10, 4 | Ln_10, 5 | Hn_10, 6 | Ln_10, 7 | Hn_10, 8 | Ln_10, 9 | Hn_10, 10 |

As shown in Table 5, taking five blue sub-pixels as one unit, the low luminance signals Ln'_3, 4 are given to the blue sub-pixels Bn_3, 4 in specific positions, to improve the resolution presented by the image quality, the low luminance signal Ln'_3,4 besides the presentation of the own low voltage signal Ln_3,4, it need to consider the low voltage signal Ln2,4, Ln_3,3, Ln_3,5, Ln_4,4, of the adjacent blue sub-pixels Bn_2,4, Bn_3,3, Bn_3,5, Bn_4,4, the four blue sub-pixel low voltage signals can be allocated on adjacent blue sub-pixels that can exhibit low luminance signals, such as the low voltage signal Ln_2,4 of Bn_2,4 can be assigned the signal Ln_1,4, Ln_2,3, Ln_2,5 and Ln_3,4 to the corresponding blue sub-pixel. Therefore, The adjacent blue sub-pixels include four blue sub-pixels Bn_2,4, Bn_3,3, Bn_3,5, Bn_4,4 are arranged in a cross shape and are arranged around Bn_3,4. Nine blue sub-pixels can be as a unit, the adjacent blue sub-pixels include eight blue sub-pixels Bn_2, 3, Bn_2,4, Bn_2,5, Bn_3,3, Bn_3,5, Bn_4,3, Bn_4,4, Bn_4,5 are arranged in a shape of Union Jack, set around Bn_3,4.

Wherein the first luminance signal is re-acquired for different weight values according to the first voltage signal of the first blue sub-pixel itself and the first voltage signals of the plurality of adjacent blue sub-pixels. Wherein the weight value of the first voltage signal of the first blue sub-pixel itself is 0.5 and the weight value of the first voltage signal of the plurality of adjacent blue sub-pixels is 0.125. Wherein the sum of the weight values of the first voltage signals of the plurality of adjacent blue sub-pixels is equal to or less than one. As shown in Table 5, with the five blue sub-pixels as a unit, Bn_3,4 for the low luminance signal presented by the new low luminance signal Ln'_3,4, in the unit, the contribution weight of all of the low-voltage signal blue sub-pixel Ln_i,j, for representation of the low luminance signal Ln'_3,4 is shown in Table 6. The Ln'_3,4 signal takes into account the low-voltage signals of the five blue sub-pixel Ln_2,4, Ln_3,3, Ln_3,5, Ln_4,4 and Ln_3,4, wherein the corresponding weight value of Ln_3,4 is 0.5, the corresponding weight value of the rest Ln_2,4, Ln_3,3, Ln_3,5, Ln_4,4 four blue sub-pixel is 0.125.

In another embodiment, the weight value of the first voltage signal of the first blue sub-pixel is equal to the sum of a plurality of weight values adjacent to the first voltage signal of its blue sub-pixel. The edge points in Table 4 will achieve better weight values.

TABLE 5

| | | | | | | | | | |
|---|---|---|---|---|---|---|---|---|---|
| Hn'_1, 1 | Ln'_1, 2 | Hn'_1, 3 | Ln'_1, 4 | Hn'_1, 5 | Ln'_1, 6 | Hn'_1, 7 | Ln'_1, 8 | Hn'_1, 9 | Ln'_1, 10 |
| Ln'_2, 1 | Hn'_2, 2 | Ln'_2, 3 | Hn'_2, 4 | Ln'_2, 5 | Hn'_2, 6 | Ln'_2, 7 | Hn'_2, 8 | Ln'_2, 9 | Hn'_2, 10 |
| Hn'_3, 1 | Ln'_3, 2 | Hn'_3, 3 | Ln'_3, 4 | Hn'_3, 5 | Ln'_3, 6 | Hn'_3, 7 | Ln'_3, 8 | Hn'_3, 9 | Ln'_3, 10 |
| Ln'_4, 1 | Hn'_4, 2 | Ln'_4, 3 | Hn'_4, 4 | Ln'_4, 5 | Hn'_4, 6 | Ln'_4, 7 | Hn'_4, 8 | Ln'_4, 9 | Hn'_4, 10 |
| Hn'_5, 1 | Ln'_5, 2 | Hn'_5, 3 | Ln'_5, 4 | Hn'_5, 5 | Ln'_5, 6 | Hn'_5, 7 | Ln'_5, 8 | Hn'_5, 9 | Ln'_5, 10 |
| Ln'_6, 1 | Hn'_6, 2 | Ln'_6, 3 | Hn'_6, 4 | Ln'_6, 5 | Hn'_6, 6 | Ln'_6, 7 | Hn'_6, 8 | Ln'_6, 9 | Hn'_6, 10 |
| Hn'_7, 1 | Ln'_7, 2 | Hn'_7, 3 | Ln'_7, 4 | Hn'_7, 5 | Ln'_7, 6 | Hn'_7, 7 | Ln'_7, 8 | Hn'_7, 9 | Ln'_7, 10 |
| Ln'_8, 1 | Hn'_8, 2 | Ln'_8, 3 | Hn'_8, 4 | Ln'_8, 5 | Hn'_8, 6 | Ln'_8, 7 | Hn'_8, 8 | Ln'_8, 9 | Hn'_8, 10 |
| Hn'_9, 1 | Ln'_9, 2 | Hn'_9, 3 | Ln'_9, 4 | Hn'_9, 5 | Ln'_9, 6 | Hn'_9, 7 | Ln'_9, 8 | Hn'_9, 9 | Ln'_9, 10 |
| Ln'_10, 1 | Hn'_10, 2 | Ln'_10, 3 | Hn'_10, 4 | Ln'_10, 5 | Hn'_10, 6 | Ln'_10, 7 | Hn'_10, 8 | Ln'_10, 9 | Hn'_10, 10 |

TABLE 6

| | | | | | | | | | |
|---|---|---|---|---|---|---|---|---|---|
| 0 | 0 | 0 | 0 | 0 | 0 | 0 | 0 | 0 | 0 |
| 0 | 0 | 0 | 0.125 | 0 | 0 | 0 | 0 | 0 | 0 |
| 0 | 0 | 0.125 | 0.5 | 0.125 | 0 | 0 | 0 | 0 | 0 |
| 0 | 0 | 0 | 0.125 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |

In one embodiment, taking the individual blue sub-pixels into account, the plurality of the blue sub-pixels in space is as the unit. The high and low luminance interval signal is used to replace the image sub-pixel signal at that original position of the blue sub-pixels in the unit. In this embodiment, every five blue sub-pixels in the space are as one unit. In this unit, Bn_2, 4 is presented with a high luminance signal. In order to maintain the presentation of the pixel resolution, the high voltage of other blue sub-pixels of the unit i.e., the sub-pixels adjacent to Bn_2,4 (Bn_1,4, Bn_2,3, Bn_2,5, Bn_3,4) is assigned to the high voltage signal of Bn_2,4 in the unit.

The calculation of the high luminance signal in specific position Bn_2,4 of the unit is the statistical that all sub-pixels in the unit need to be given high luminance signal compensation theoretically, and the actual positional influence of the corresponding position of the individual sub-pixels in the unit is weighted, so that the compensation effect of the high luminance sub-pixel signal can be met the effect of averaging required compensation of the unit.

As shown in Table 7, taking five blue sub-pixels as one unit, the high luminance signals Hn'_2, 4 are given to the blue sub-pixels Bn_2, 4 in specific positions, to improve the resolution presented by the image quality, the high luminance signal Hn'_2,4 besides the presentation of the own high voltage signal Hn_2,4, it need to consider the high voltage signal Hn_1,4, Hn_2,3, Hn_2,5 and Hn_3,4. of the adjacent blue sub-pixels Bn_1,4, Bn_2,3, Bn_2,5, Bn_3,4, the four blue sub-pixel high voltage signals can be allocated on adjacent blue sub-pixels that can exhibit high luminance signals, such as the high voltage signal Hn_3,4 of Bn_3,4 can be assigned the signal Hn_2,4, Hn_3,3, Hn_3,5 and Hn_4,4 to the corresponding blue sub-pixel. Therefore, the adjacent blue sub-pixels include four blue sub-pixels Bn_1, 4, Bn_2,3, Bn_2,5, Bn_3,4 are arranged in a cross shape and are arranged around Bn_2,4. Nine blue sub-pixels can be as a unit, the adjacent blue sub-pixels include eight blue sub-pixels Bn_1,3, Bn_1,4, Bn_1,5, Bn_2,3, Bn_2,5, Bn_3, 3, Bn_3,4, Bn_3,5 are arranged in a shape of Union Jack, set around Bn_2,4.

TABLE 7

| | | | | | | | | | |
|---|---|---|---|---|---|---|---|---|---|
| Hn'_1, 1 | Ln'_1, 2 | Hn'_1, 3 | Ln'_1, 4 | Hn'_1, 5 | Ln'_1, 6 | Hn'_1, 7 | Ln'_1, 8 | Hn'_1, 9 | Ln'_1, 10 |
| Ln'_2, 1 | Hn'_2, 2 | Ln'_2, 3 | Hn'_2, 4 | Ln'_2, 5 | Hn'_2, 6 | Ln'_2, 7 | Hn'_2, 8 | Ln'_2, 9 | Hn'_2, 10 |
| Hn'_3, 1 | Ln'_3, 2 | Hn'_3, 3 | Ln'_3, 4 | Hn'_3, 5 | Ln'_3, 6 | Hn'_3, 7 | Ln'_3, 8 | Hn'_3, 9 | Ln'_3, 10 |
| Ln'_4, 1 | Hn'_4, 2 | Ln'_4, 3 | Hn'_4, 4 | Ln'_4, 5 | Hn'_4, 6 | Ln'_4, 7 | Hn'_4, 8 | Ln'_4, 9 | Hn'_4, 10 |
| Hn'_5, 1 | Ln'_5, 2 | Hn'_5, 3 | Ln'_5, 4 | Hn'_5, 5 | Ln'_5, 6 | Hn'_5, 7 | Ln'_5, 8 | Hn'_5, 9 | Ln'_5, 10 |
| Ln'_6, 1 | Hn'_6, 2 | Ln'_6, 3 | Hn'_6, 4 | Ln'_6, 5 | Hn'_6, 6 | Ln'_6, 7 | Hn'_6, 8 | Ln'_6, 9 | Hn'_6, 10 |
| Hn'_7, 1 | Ln'_7, 2 | Hn'_7, 3 | Ln'_7, 4 | Hn'_7, 5 | Ln'_7, 6 | Hn'_7, 7 | Ln'_7, 8 | Hn'_7, 9 | Ln'_7, 10 |
| Ln'_8, 1 | Hn'_8, 2 | Ln'_8, 3 | Hn'_8, 4 | Ln'_8, 5 | Hn'_8, 6 | Ln'_8, 7 | Hn'_8, 8 | Ln'_8, 9 | Hn'_8, 10 |

TABLE 7-continued

| | | | | | | | | | |
|---|---|---|---|---|---|---|---|---|---|
| Hn'_9, 1 | Ln'_9, 2 | Hn'_9, 3 | Ln'_9, 4 | Hn'_9, 5 | Ln'_9, 6 | Hn'_9, 7 | Ln'_9, 8 | Hn'_9, 9 | Ln'_9, 10 |
| Ln'_10, 1 | Hn'_10, 2 | Ln'_10, 3 | Hn'_10, 4 | Ln'_10, 5 | Hn'_10, 6 | Ln'_10, 7 | Hn'_10, 8 | Ln'_10, 9 | Hn'_10, 10 |

As shown in Table 7, with the five blue sub-pixels as a unit, Bn_2,4 for the high luminance signal presented by the new high luminance signal Hn'_2,4, in the unit, the contribution weight of all of the high voltage signal blue sub-pixel Hn_i,j, for representation of the high luminance signal Hn'_2,4 is shown in Table 8. The Hn'_2,4 signal takes into account the high voltage signals of the five blue sub-pixel Hn_1,4, Hn_2,3, Hn_2,5, Hn_3,4 and Hn_3,4, wherein the corresponding weight value of Hn_2,4 is 0.5, the corresponding weight value of the rest Hn_1,4, Hn_2,3, Hn_2,5, Hn_3,4 four blue sub-pixel is 0.125.

In another embodiment, the weight value of the second voltage signal of the second blue sub-pixel is equal to the sum of a plurality of weight values adjacent to the second voltage signal of its blue sub-pixel. The edge points in Table 4 will achieve better weight values.

TABLE 8

| | | | | | | | | | |
|---|---|---|---|---|---|---|---|---|---|
| 0 | 0 | 0 | 0.125 | 0 | 0 | 0 | 0 | 0 | 0 |
| 0 | 0 | 0.125 | 0.5 | 0.125 | 0 | 0 | 0 | 0 | 0 |
| 0 | 0 | 0 | 0.125 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |

Therefore, in the present embodiment, the low gray scale luminance representative signals Ln'_3, 4 given to the position Bn_3,4 is Ln'_3,4=0.5*Ln_3,4+0.125*(Ln_2,4+Ln_3,3+Ln_3,5+Ln_4,4).

Similarly, the luminance represents signal H'_24 of the high luminance position Bn_2,4 is Hn'_2,4=0.5*Hn_2,4+0.125*(Hn_1,4+Hn_2,3+Hn_2,5+Hn_3,4).

And so on, each high and low voltage luminance position can be equivalent to the same results, to achieve the viewing angle compensation and also be the presentation of the image resolution.

Figure 14:
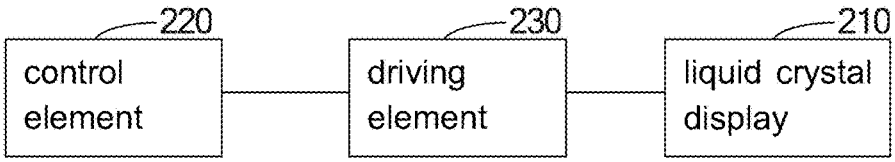
FIG. 14 is a block diagram of a display device in an embodiment.

The present application also provides a display device, the display device can perform the above-described driving method. As shown in FIG. 14, the display device includes a display panel 210, a control element 220, and a driving element 230.

The display device can be a TN, an OCB, a VA type, and a curve-surface display device, but the present application is not limited thereto. The display device can use a direct type backlight, and the backlight source can be a white light, an RGB three-color light source, an RGBW four-color light source, or an RGBY four-color light source, but is not limited thereto.

The display device can also be, for example, an OLED display panel, a QLED display device, a curve-surface display device, or other display device.

Wherein the pixel units of the display panel 210 are divided into a plurality of pixel sets; the blue sub-pixels of each pixel set are divided into a plurality of blue pixel pairs, each pair of blue pixel pairs including a first blue sub-pixels and a second blue sub-pixel adjacent to each other, the first blue sub-pixel in one of the adjacent blue pixel pairs is arranged adjacent to the second blue sub-pixel in the other one of the adjacent blue pixel pairs.

The control element 220 includes an acquisition unit and a calculation unit, the acquisition unit is for acquiring the original driving data for each pixel set, the calculation unit is for acquiring a hue of each pixel set according to the original driving data, acquiring the gray scale value lookup table according to the hue range of the hue; the original driving data for each of the blue sub-pixels in the gray scale value lookup table corresponds to a set of target gray scale value set, each set of the target gray scale value set includes an unequal first voltage signal and a second voltage signal, calculation unit is making the front viewing angle mixing luminance of the blue sub-pixel is alternately driven by the first voltage signal and the second voltage signal, and that is equivalent to the front viewing angle luminance of the original driving data to drive the blue sub-pixel. Wherein, the calculation unit is further configured to re-acquire the first luminance signal according to a different weight of the first voltage signal of the blue sub-pixel and the first voltage signal of a plurality of adjacent blue sub-pixels respectively, and re-acquire the second luminance signal according to a different weight of the second voltage signal of the blue sub-pixel and the second voltage signal of a plurality of adjacent blue sub-pixels respectively, The driving element 230 is connected to the control element 220 and the liquid crystal display panel 210, respectively; the driving element 230 is for driving the first blue sub-pixel in accordance with the first luminance signal and driving the second blue sub-pixel in accordance with the second luminance signal.

In another embodiment, the calculation unit is further adapted to calculate an average gray scale value for the various color of the sub-pixels in each pixel set according to the original driving data; and to obtain the hue of each of the pixel set according to the average gray scale value of the various color sub-pixels in each pixel set.

In another embodiment, the calculation unit is further adapted to obtain the color purity of each pixel set according to the image input signal; the acquisition unit is further adapted to obtain the corresponding gray scale value lookup table according to the range of the hue and the color purity of each pixel set.

In another embodiment, the weight value of the first voltage signal of the first blue sub-pixel is equal to the sum of a plurality of weight values of the first voltage signal adjacent to the blue sub-pixel; and the weight value of the second voltage signal of the second blue sub-pixel is equal to the sum of a plurality of weight values of the second voltage signal adjacent to the blue sub-pixel.

In another embodiment, the blue sub-pixels adjacent to the first blue sub-pixel include four blue sub-pixels and are arranged in a cross shape, and the blue sub-pixels adjacent to the second blue sub-pixel include four blue sub-pixels and are arranged in a cross shape.

In another embodiment, the blue sub-pixels adjacent to the first blue sub-pixel include eight blue sub-pixels and are arranged in a shape of Union Jack-shaped form, and the blue sub-pixels adjacent to the second blue sub-pixel include eight blue sub-pixels and are arranged in a shape of Union Jack-shaped form.

The technical features of the embodiments described above can be arbitrarily combined, and in order to make the description simple and not to describe all possible combinations of the various technical features in the above embodiments, as long as there is no contradiction in the combination of these technical features, Should be considered as the scope of this specification.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A method for driving display panel pixel, comprising:

dividing a pixel unit of a display panel into a plurality of pixel sets;

acquiring an original driving data for each of the pixel sets, a hue of each of the pixel sets being acquired according to the original driving data;

acquiring a gray scale value lookup table according to a belonging range of the hue, the original driving data of every blue sub-pixels in the gray scale value lookup table corresponding to a set of target gray scale value pair, each set of the target gray scale value pair comprising a first voltage signal and a second voltage signal unequal to each other, and a front viewing angle mixing luminance of the blue sub-pixels alternately driven by the first voltage signals and the second voltage signals being equivalent to a front viewing angle luminance of the blue sub-pixels driven by the original driving data;

dividing the blue sub-pixels of each pixel set into a plurality sets of blue pixel pairs, each blue pixel pair comprising a first blue sub-pixel and a second blue sub-pixel adjacent to each other, and the first blue sub-pixel of one of the blue pixel pairs of the adjacent blue pixel pairs being arranged adjacent to the second blue sub-pixel in the other one of the blue pixel pairs;

acquiring a first luminance signal according to different weight values from the first voltage signal of the first blue sub-pixel and the first voltage signals of the plurality of adjacent blue sub-pixels, the first blue sub-pixel being driven according to the first luminance signal; and acquiring a second luminance signal according to different weight values from the second voltage signal of the second blue sub-pixel and the second voltage signals of the plurality of adjacent blue sub-pixels, the second blue sub-pixel being driven according to the second luminance signal.

2. The method according to claim 1, wherein the step of acquiring the hue of each of the pixel sets according to the original driving data comprises:

calculating an average gray scale value of various colors of the sub-pixels in each pixel set according to the original driving data; and acquiring the hue of each of the pixel sets according to the average gray scale value of the various colors of the sub-pixels in each pixel set.

3. The method according to claim 1, wherein the step of acquiring the hue of each of the pixel sets according to the original driving data further comprises:

acquiring a color purity of each pixel set according to the original driving data; and the step of acquiring the gray scale value lookup table according to the belonging range of the hue further comprises:

acquiring the corresponding gray scale value lookup table according to a belonging range of the hue and the color purity of each pixel set.

4. The method according to claim 3, wherein the blue sub-pixels adjacent to the first blue sub-pixel comprise four blue sub-pixels and are arranged in a cross shape, and the blue sub-pixels adjacent to the second blue sub-pixel comprise four blue sub-pixels and are arranged in a cross shape.

5. The method according to claim 1, wherein the step of acquiring the first luminance signal according to different weight values from the first voltage signal of the first blue sub-pixel and the first voltage signals of the plurality of adjacent blue sub-pixels comprises:

the weight value of the first voltage signal of the first blue sub-pixel being equal to the sum of the weight values of the first voltage signals of the plurality of the adjacent blue sub-pixels; and the step of acquiring the second luminance signal according to different weight values from the second voltage signal of the second blue sub-pixel and the second voltage signals of the plurality of adjacent blue sub-pixels, comprising:

the weight value of the second voltage signal of the second blue sub-pixel being equal to the sum of the weight values of the second voltage signals of the plurality of the adjacent blue sub-pixels.

6. The method according to claim 1, wherein the difference between the first voltage signal and the second voltage signal is greater than a preset difference range.

7. A method for driving a display panel pixel, comprising:

dividing a pixel unit of a display panel into a plurality of pixel sets;

acquiring an original driving data for each of the pixel sets, calculating an average gray scale value of various colors of the sub-pixels in each pixel set according to the original driving data, and acquiring the hue of each of the pixel sets according to the average gray scale value of the various colors of the sub-pixels in each pixel set;

acquiring a gray scale value lookup table according to a belonging range of the hue, the original driving data of every blue sub-pixels in the gray scale value lookup table corresponding to a set of target gray scale value pair, each set of the target gray scale value pair comprising a first voltage signal and a second voltage signal unequal to each other, and a front viewing angle mixing luminance of the blue sub-pixels alternately driven by the first voltage signals and the second voltage signals being equivalent to a front viewing angle luminance of the blue sub-pixels driven by the original driving data;

dividing the blue sub-pixels of each pixel set into a plurality sets of blue pixel pairs, each blue pixel pair comprising a first blue sub-pixel and a second blue sub-pixel adjacent to each other, the first blue sub-pixel of one of the blue pixel pairs of the adjacent blue pixel pairs being arranged adjacent to the second blue sub-pixel in the other one of the blue pixel pairs;

acquiring a first luminance signal according to different weight values from the first voltage signal of the first blue sub-pixel and the first voltage signals of the plurality of adjacent blue sub-pixels, the first blue sub-pixel being driven according to the first luminance signal; and acquiring a second luminance signal according to different weight values from the second voltage signal of the second blue sub-pixel and the second voltage signals of the plurality of adjacent blue sub-pixels, the second blue sub-pixel being driven according to the second luminance signal.

8. The method according to claim 7, wherein the step of acquiring the first luminance signal according to different weight values from the first voltage signal of the first blue sub-pixel and the first voltage signals of the plurality of adjacent blue sub-pixels comprises:

the weight value of the first voltage signal of the first blue sub-pixel is equal to the sum of the weight values of the first voltage signals of the plurality of the adjacent blue sub-pixels; and the step of acquiring the second luminance signal according to different weight values from the second voltage signal of the second blue sub-pixel and the second voltage signals of the plurality of adjacent blue sub-pixels comprises:

the weight value of the second voltage signal of the second blue sub-pixel is equal to the sum of the weight values of the second voltage signals of the plurality of the adjacent blue sub-pixels.

9. The method according to claim 8, wherein the blue sub-pixels adjacent to the first blue sub-pixel comprise four blue sub-pixels and are arranged in a cross shape, and the blue sub-pixels adjacent to the second blue sub-pixel comprise four blue sub-pixels and are arranged in a cross shape.

10. The method according to claim 7, wherein the difference between the first voltage signal and the second voltage signal is greater than a preset difference range.

11. A display device, comprising:

a display panel, a pixel unit of the display panel being divided into a plurality of pixel sets, blue sub-pixels of each pixel set being divided into a plurality of blue pixel pairs, each blue pixel pair comprising a first blue sub-pixel and a second blue sub-pixel adjacent to each other, and the first blue sub-pixel of one of the blue pixel pairs of the adjacent blue pixel pairs being arranged adjacent to the second blue sub-pixel in the other one of the blue pixel pairs;

a control circuit, wherein the control circuit comprises:

an acquisition circuit configured to acquire an original driving data for each pixel set; and a calculation circuit, coupled to the acquisition circuit and configured to acquire a hue of each pixel set according to the original driving data, and to acquire a gray scale value lookup table according to a belonging range of the hue, the original driving data of every blue sub-pixels in the gray scale value lookup table corresponding to a set of target gray scale value pair, each set of the target gray scale value pairs comprising a first voltage signal and a second voltage signal unequal to each other, and the calculation circuit making a front viewing angle mixing luminance of the blue sub-pixels alternately driven by the first voltage signals and the second voltage signals being equivalent to a front viewing angle luminance of the blue sub-pixels driven by the original driving data, wherein the calculation circuit is further configured to re-acquire a first luminance signal according to different weight values from the first voltage signal of the first blue sub-pixel and the first voltage signals of the plurality of adjacent blue sub-pixels, re-acquire a second luminance signal according to different weight values from the second voltage signal of the second blue sub-pixel and the second voltage signals of the plurality of adjacent blue sub-pixels; and a driving circuit coupled to the calculation circuit and connected to the display panel, wherein the driving circuit is configured to drive the first blue sub-pixels in accordance with the first luminance signal and to drive the second blue sub-pixels in accordance with the second luminance signal.

12. The display device according to claim 11, wherein the calculation circuit is further configured to calculate an average gray scale value of various colors of the sub-pixels in each pixel set according to the original driving data; and to acquire the hue of each of the pixel sets according to the average gray scale value of the various colors of the sub-pixels in each pixel set.

13. The display device according to claim 11, wherein the calculation circuit is further configured to acquire color purities of each pixel sets according to image input signals; the acquisition circuit is further configured to acquire the corresponding gray scale value lookup table according to the belonging range of the hue and the color purity of each pixel set.

14. The display device according to claim 11, wherein the weight values from the first voltage signal of the first blue sub-pixel is equal to the sum of the weight values of the first voltage signals of the plurality of the adjacent blue sub-pixels; and the weight values from the second voltage signal of the second blue sub-pixel is equal to the sum of the weight values of the second voltage signals of the plurality of the adjacent blue sub-pixels.

15. The display device according to claim 11, wherein the blue sub-pixels adjacent to the first blue sub-pixel comprise four blue sub-pixels and are arranged in a cross shape, and the blue sub-pixels adjacent to the second blue sub-pixel comprise four blue sub-pixels and are arranged in a cross shape.

16. The display device according to claim 11, wherein the difference between the first voltage signal and the second voltage signal is greater than a preset difference range.

* * * * *